US008562287B2

(12) United States Patent
Schmidt et al.

(10) Patent No.: US 8,562,287 B2
(45) Date of Patent: Oct. 22, 2013

(54) GRINDER PUMP

(75) Inventors: William Schmidt, Leitchfield, KY (US); Charles Carroll, Louisville, KY (US); Bryan Schilling, Louisville, KY (US)

(73) Assignee: Zoeller Pump Company, LLC, Louisville, KY (US)

( * ) Notice: Subject to any disclaimer, the term of this patent is extended or adjusted under 35 U.S.C. 154(b) by 767 days.

(21) Appl. No.: 12/749,134

(22) Filed: Mar. 29, 2010

(65) Prior Publication Data

US 2010/0322756 A1 Dec. 23, 2010

Related U.S. Application Data

(60) Provisional application No. 61/219,657, filed on Jun. 23, 2009.

(51) Int. Cl.
*F04D 25/14* (2006.01)

(52) U.S. Cl.
USPC ..... 415/121.1

(58) Field of Classification Search
USPC ..... 415/121.1, 121.2; 416/203, 198 R, 416/210 A, 198 A, 231 R, 231 A, 231 B; 417/423.9, 423.3
See application file for complete search history.

(56) References Cited

U.S. PATENT DOCUMENTS

| | | | | |
|---|---|---|---|---|
| 1,992,891 | A | 2/1935 | Schmidt | |
| 2,090,650 | A * | 8/1937 | Vant | 241/82.4 |
| 2,658,453 | A | 11/1953 | Walters | |
| 2,710,035 | A * | 6/1955 | Plummer | 241/58 |
| 3,036,614 | A | 5/1962 | Knapp | |
| 3,155,046 | A | 11/1964 | Vaughan | |
| 3,313,332 | A * | 4/1967 | Stephan et al. | 241/98 |
| 3,343,350 | A | 9/1967 | Freedlander et al. | |
| 3,784,118 | A | 1/1974 | Hurwitz | |
| 3,973,866 | A * | 8/1976 | Vaughan | 415/121.1 |
| 4,114,815 | A | 9/1978 | Gijsbers | |
| 4,182,499 | A | 1/1980 | Kemper | |
| 4,378,093 | A | 3/1983 | Keener | |
| D268,641 | S | 4/1983 | Bonforte | |
| 4,408,724 | A | 10/1983 | Meyer | |
| 4,430,214 | A | 2/1984 | Baker | |
| D277,860 | S | 3/1985 | Hellden | |
| D299,348 | S | 1/1989 | Nja | |
| 5,346,143 | A | 9/1994 | Askin | |
| 5,394,612 | A | 3/1995 | Wolfington | |
| D389,382 | S | 1/1998 | Houle | |
| 5,850,782 | A | 12/1998 | Aasted | |

(Continued)

OTHER PUBLICATIONS

"Sanibest" system, SFA-Saniflo Inc., technical data.

(Continued)

*Primary Examiner* — Ninh H Nguyen
(74) *Attorney, Agent, or Firm* — Wyatt, Tarrant & Combs, LLP; Stephen C. Hall

(57) ABSTRACT

A pump is provided including a cutter plate disposed at a pump inlet including a plurality of holes. Multiple embodiments provide that the pump includes a rotatable cutter blade disposed substantially adjacent to the cutter plate. Embodiments include those wherein the plurality of holes are angled in a direction of rotation of the cutter blade. In some embodiments, the cutter blade has at least one relief hole and at least one cutting edge. Additional embodiments include those wherein a ring extends outward from the pump inlet for channeling material toward the pump inlet in a substantially perpendicular approach with respect to the cutter plate.

16 Claims, 17 Drawing Sheets

(56) References Cited

U.S. PATENT DOCUMENTS

| | | | | |
|---|---|---|---|---|
| D440,981 | S | 4/2001 | Burch | |
| D462,702 | S | 9/2002 | Neuerburg | |
| D488,347 | S | 4/2004 | Boozer et al. | |
| D493,476 | S | 7/2004 | Apfel et al. | |
| D502,185 | S | 2/2005 | Byrne | |
| 6,969,018 | B2 | 11/2005 | Gimenez Ibanez et al. | |
| D515,104 | S | 2/2006 | Fujiki et al. | |
| D524,827 | S | 7/2006 | Byrne | |
| D528,859 | S | 9/2006 | Boozer et al. | |
| 7,125,221 | B2 * | 10/2006 | Dorsch et al. | 415/121.1 |
| 7,159,806 | B1 | 1/2007 | Ritsema | |
| D577,372 | S | 9/2008 | Hung | |
| 7,520,454 | B2 | 4/2009 | Zelder et al. | |
| D618,075 | S | 6/2010 | Huang | |
| D633,110 | S | 2/2011 | Neuerburg | |
| 2010/0319116 | A1 | 12/2010 | Schmidt et al. | |

OTHER PUBLICATIONS

"Sanibest" system, SFA-Saniflo Inc., computer printout accessed Jan. 19, 2010.

* cited by examiner

GRINDER PUMP

CROSS REFERENCES TO RELATED APPLICATIONS

This application claims priority to U.S. Provisional Application No. 61,219,657 filed on Jun. 23, 2009. This application is related to U.S. patent application Ser. No. 12/749,153 entitled "Waste Pumping System" assigned to the same assignee as the present application.

MULTIPLE EMBODIMENTS AND ALTERNATIVES

Figure 1:
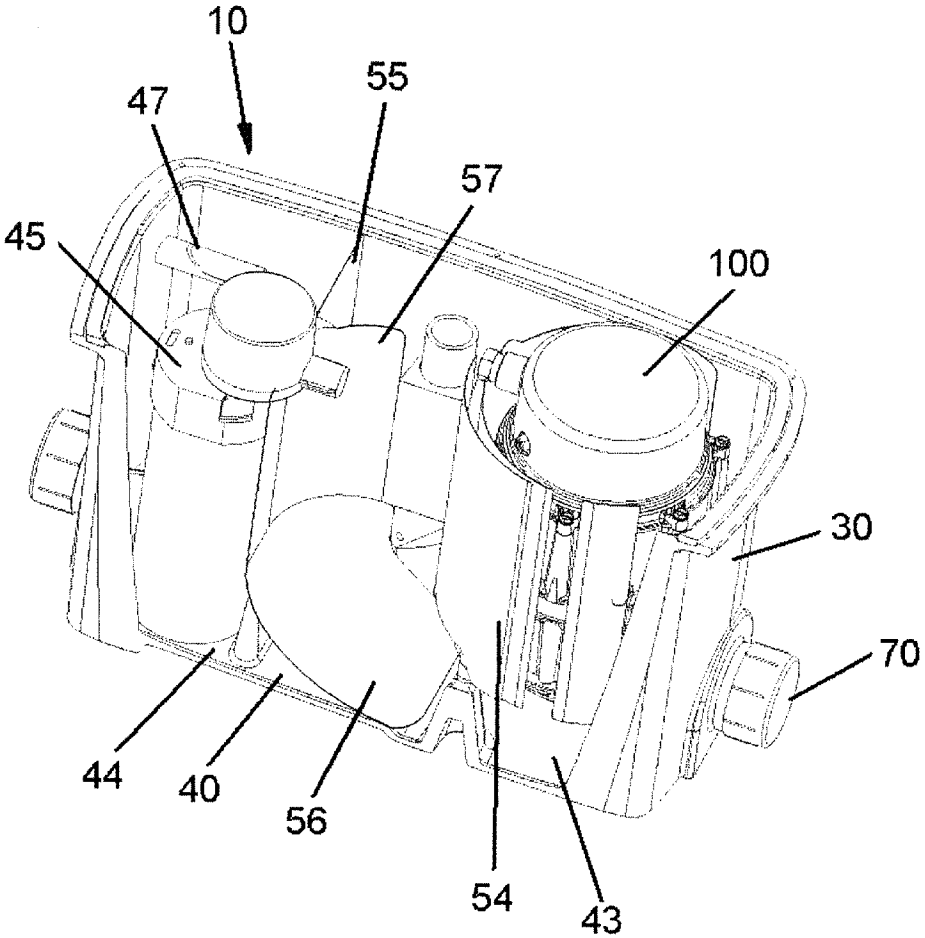
FIG. 1 is a cutaway perspective view of a waste pumping system according to multiple embodiments and alternatives.
Figure 2:
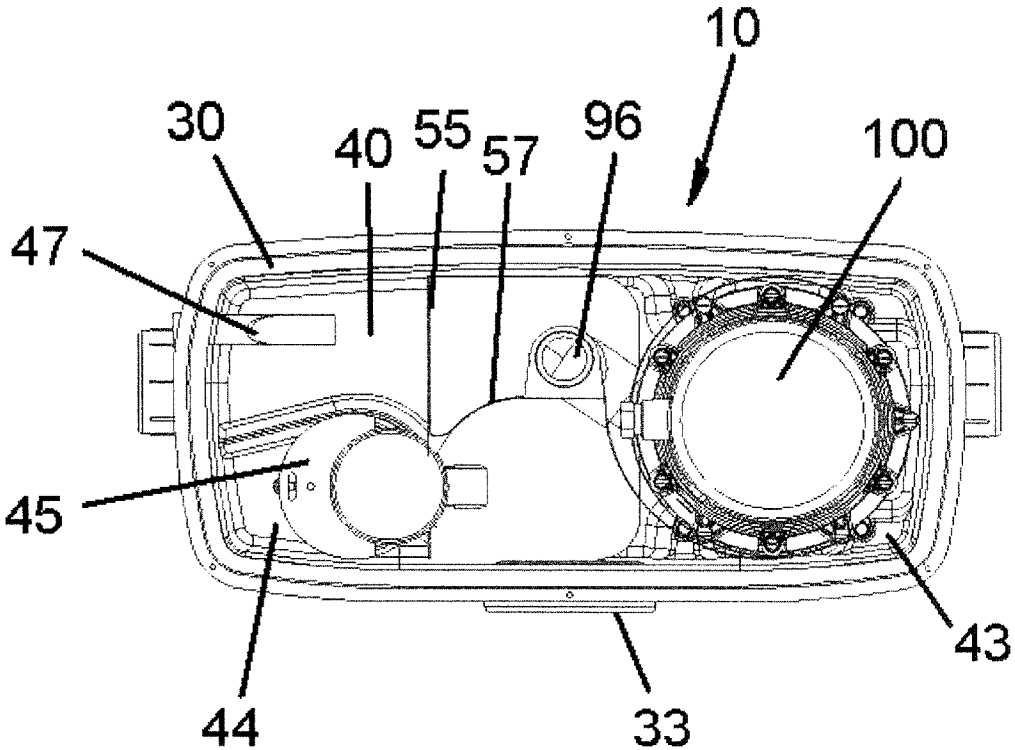
FIG. 2 is a plan view of a waste pumping system according to multiple embodiments and alternatives.
Figure 4:
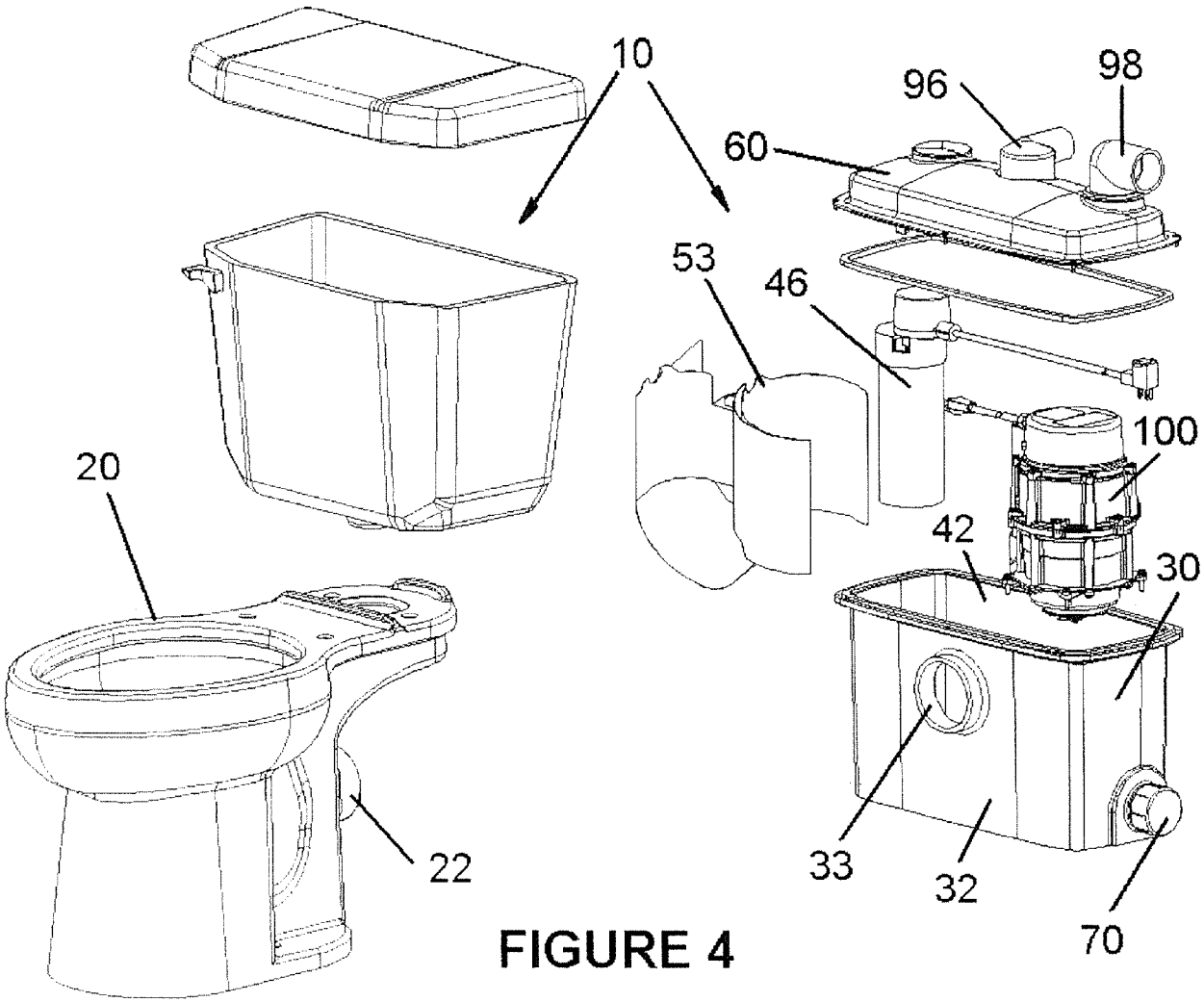
FIG. 4 is an exploded view of a waste pumping system showing a toilet according to multiple embodiments and alternatives.
Figure 5:
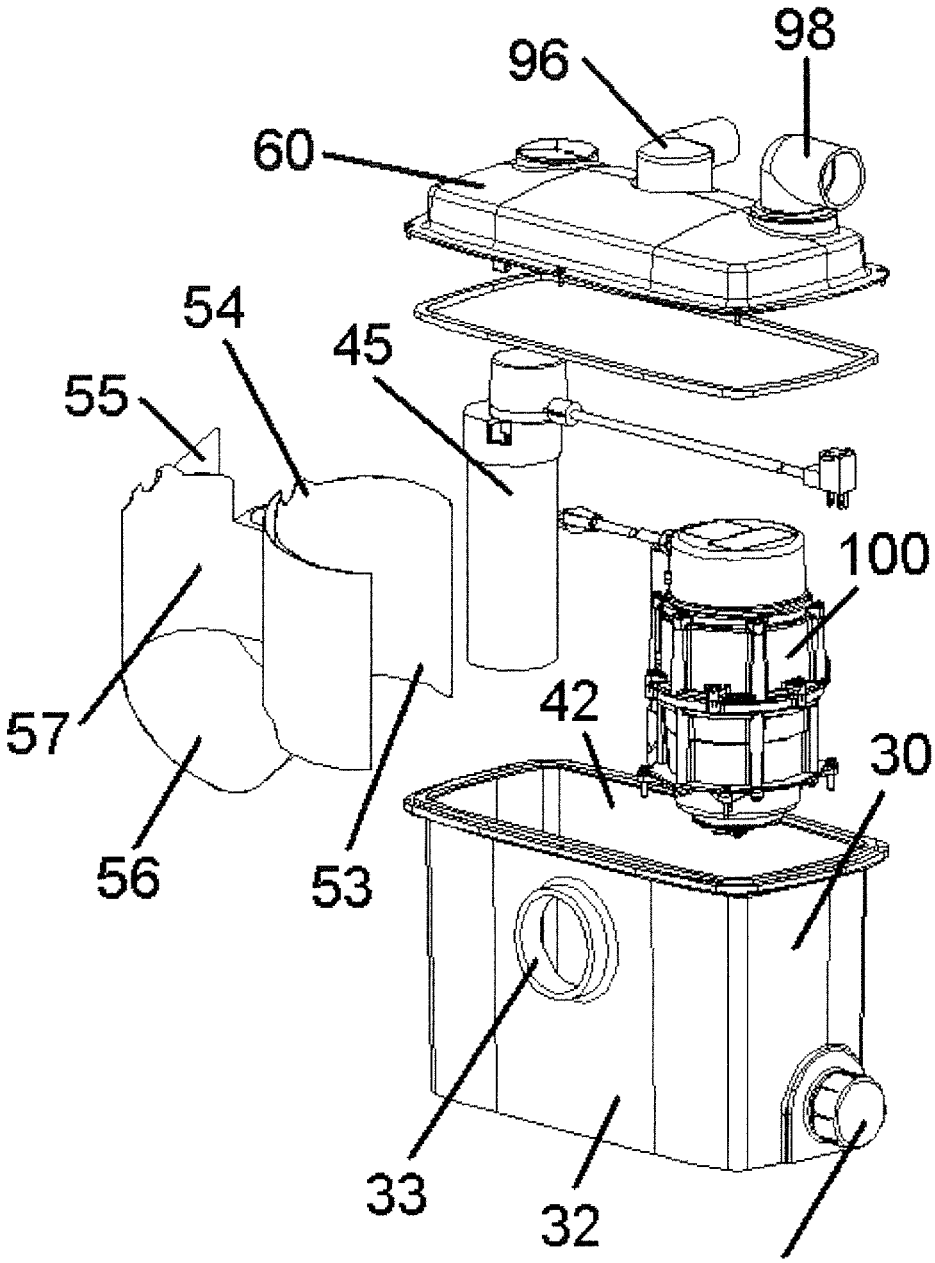
FIG. 5 is an exploded view of a waste pumping system according to multiple embodiments and alternatives.
Figure 10:
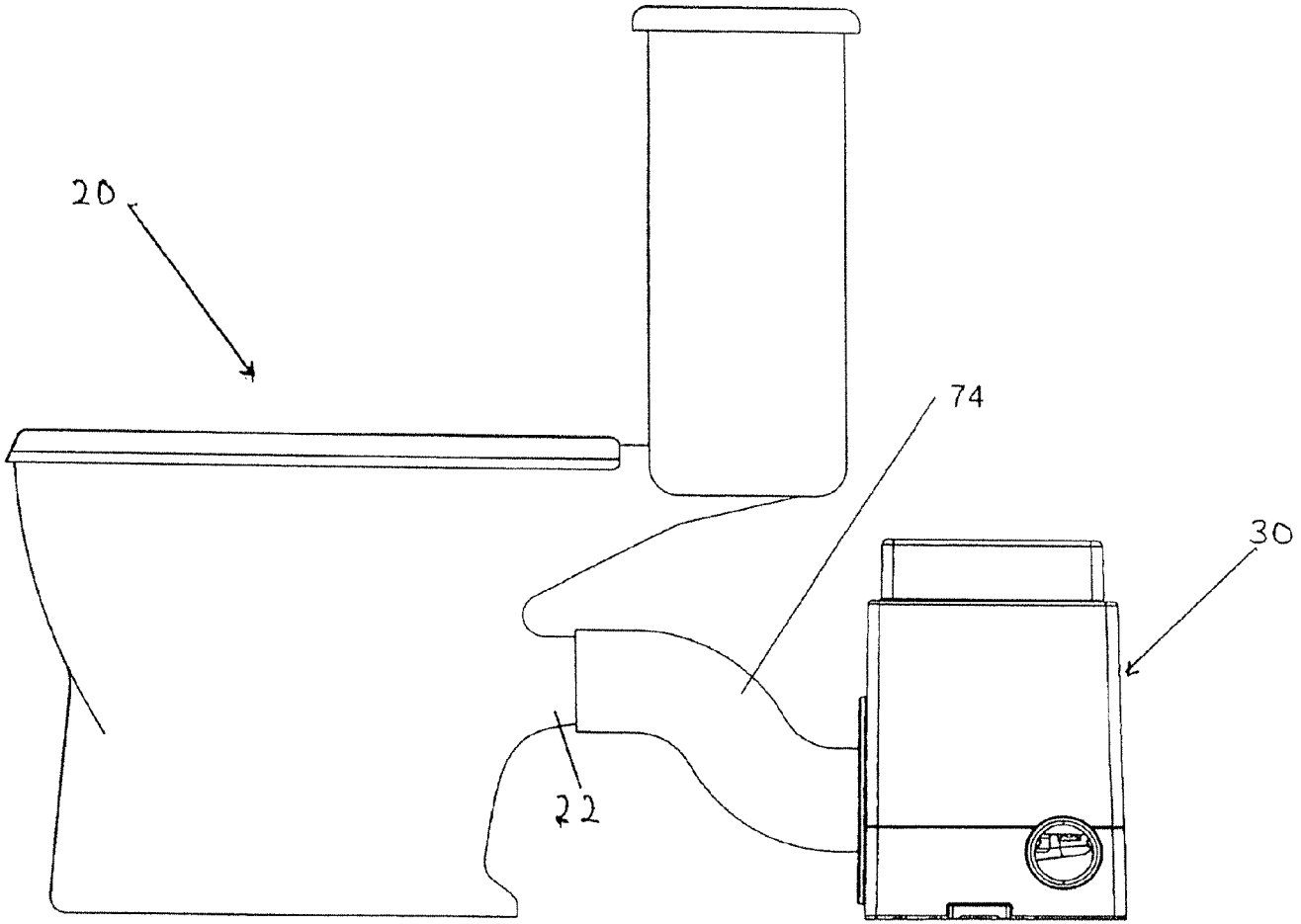
FIG. 10 is a side elevation view of a waste pumping system according to multiple embodiments and alternatives.

Multiple embodiments and alternatives are provided for a waste pumping system 10 and a pump 100. With reference to FIG. 10, an embodiment of a waste pumping system 10 collects and disposes of waste from a toilet 20. Embodiments include those wherein the toilet 20 is a conventional, rear outlet toilet. Waste passes from the toilet 20 through a toilet outlet 22 into a tank 30. The tank 30 includes a tank floor 40 as shown in FIGS. 1 and 2 and a tank body 42 as shown in FIGS. 4 and 5. The tank floor 40 and the tank body 42 are joined hermetically to create the tank 30. The tank 30 is manufactured of conventional materials commonly utilized in bathroom fixtures including but not limited to plastics and porcelain.

Figure 3:
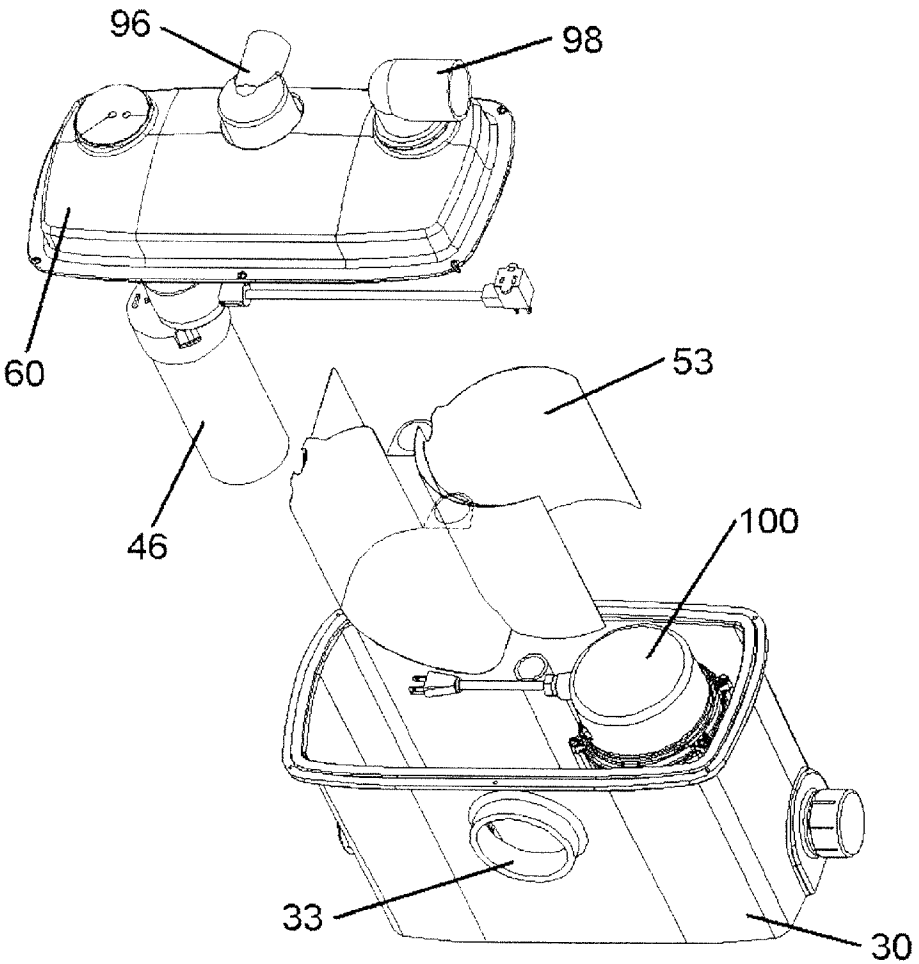
FIG. 3 is an exploded view of a waste pumping system according to multiple embodiments and alternatives.

With reference to FIGS. 3 and 4, waste and fluid from the toilet 20 flows into the tank 30 through the tank inlet 33.

Embodiments include those wherein the tank inlet 33 is disposed on the front side 32 of the tank 30. In some embodiments, the tank inlet 33 is located on the lower portion of the front side 32 of the tank 30; this permits connection of the tank 30 to conventional, rear outlet toilets 20. For example, embodiments include those wherein the center of the tank inlet 33 is located about 4 inches from the bottom edge of the tank 30. In other embodiments, the center of the tank inlet 33 is located about 7 inches from the bottom edge of the tank 30.

With reference to FIG. 10, alternative embodiments include those wherein the toilet 20 is connected to the tank inlet 33 with attachment piping 74. In some embodiments, the attachment piping 74 is adjustable such that the tank 30 can be attached to toilets 20 with toilet outlets 22 at various heights. The attachment piping 74 may be comprised of conventional materials suitable for attachment to both the toilet outlet 22 and the tank inlet 33.

Figure 8:
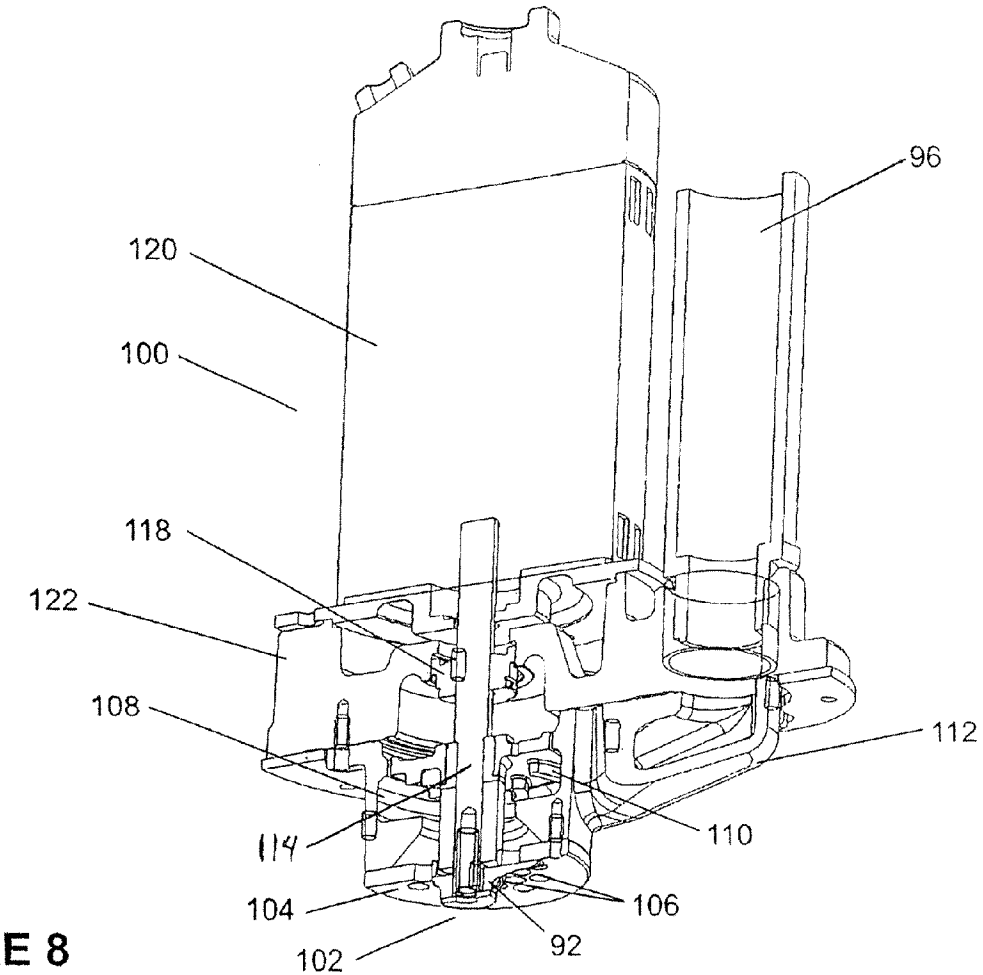
FIG. 8 is a cutaway perspective view of a pump according to multiple embodiments and alternatives.

The waste pumping system 10 further includes a pump 100 with a pump inlet 102 as shown in FIG. 8. With reference to FIG. 1, embodiments include those wherein the tank 30 includes a first designated area 43. In multiple embodiments, the pump inlet 102 is disposed within the first designated area 43. In some embodiments, the pump 100 is substantially contained within the first designated area 43. In some embodiments, the pump 100 is mounted to the tank 30.

Embodiments include those wherein the floor 40 of the tank 30 gradually descends from the side of the tank 30 located furthest from the first designated area 43 to the pump 100 itself. This descent promotes the efficient evacuation of the tank 30.

Embodiments include those wherein the angle of descent of the floor 40 to the pump 100 is at least about 2°-5°; however, embodiments include those wherein the angle of descent is provided in any suitable angle.

In multiple embodiments, the tank 30 includes a second designated area 44. Embodiments include those wherein the second designated area 44 contains a sensing system 45 which senses a volume, pressure, level and/or quantity of material and/or fluid within the tank 30. Embodiments of the sensing system 45 are capable of sensing the presence of fluid or material within the tank 30 and activating the pump 100. For example, in some embodiments, the sensing system 45 senses the presence of fluid or material within the tank 30 and activates the pump 100. In one embodiment, the sensing system 45 is a float system 46 which controls activation of the pump 100 as shown in FIG. 3. The float system 46 is conventional in design and operation. However, embodiments include those wherein a sensing system 45 senses the volume, pressure, level or quantity of material and/or fluid within the tank 30, such as, for example, an electronic probe (not shown) for sensing the volume of fluid within the tank 30.

Figure 6:
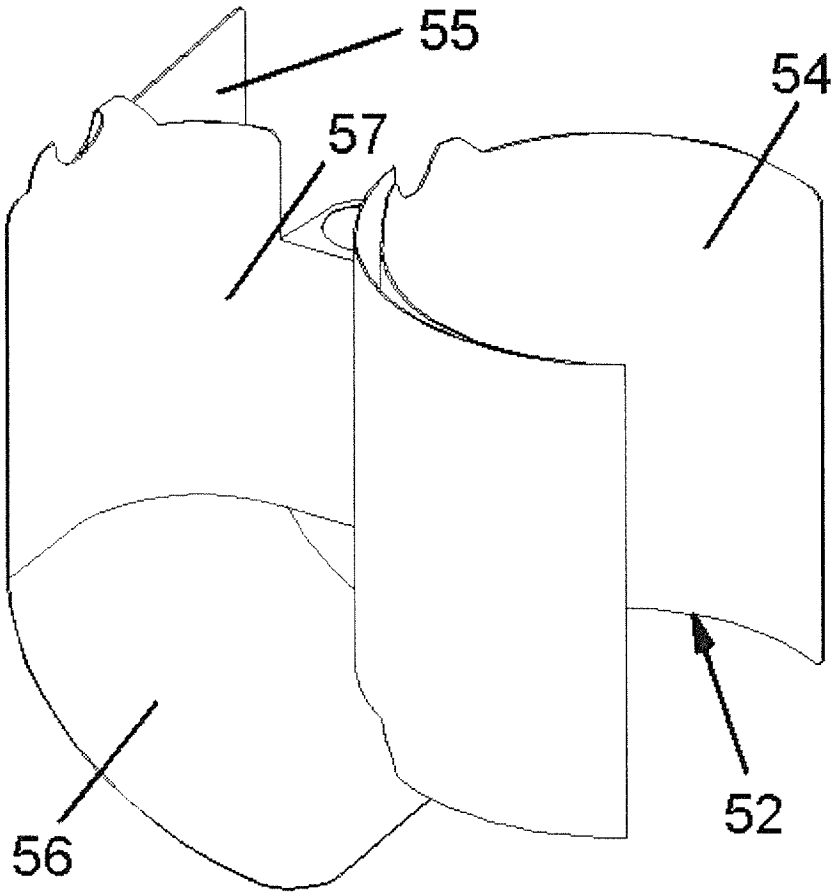
FIG. 6 is a perspective view of a baffle system according to multiple embodiments and alternatives.

With reference to FIG. 6, embodiments include those wherein the tank 30 includes a baffle system 52 comprised of at least one baffle 53. The number of baffles 53 as well as their locations and shapes are arranged as desired in order to provide an efficient flow of material through the tank 30 toward the pump 100. The baffles 53 may be constructed of any sturdy material including but not limited to plastic. In some embodiments, the baffles 53 are constructed of the same material as is the tank 30.

With reference to FIGS. 1 and 2, in multiple embodiments, the baffle system 52 includes a means for shielding the pump 100. The means for shielding the pump 100 operates as a divider between the tank inlet 33 and the pump 100 and shields the pump 100 from initial contact with at least a portion of the material entering the tank 30 through the tank inlet 33. In some embodiments, the means for shielding the pump 100 consists of a first baffle portion 54 formed from at least one baffle 53 which shields the pump 100 from initial contact with at least a portion of the material entering the tank 30 through the tank inlet 33. In some embodiments, the first baffle portion 54 also aids in directing material downward such that the material can be further directed toward the pump 100. Embodiments include those wherein the first designated area 43 is formed by the first baffle portion 54 and the sides of the tank 30. In some embodiments, the height of the first baffle portion 54 is sufficient so that material which enters the tank 30 cannot flow over the top of the first baffle portion 54. Thus, in some embodiments, the height of the first baffle portion 54 is at least as high as the top of the toilet outlet 22. In some embodiments, the first baffle portion 54 is substantially vertical with respect to the tank floor 40. In some embodiments, the first baffle portion 54 consists of a semi-circular baffle portion. The first baffle portion 54 permits material to flow into the first designated area 43. In some embodiments, there is at least one gap between the first baffle portion 54 and the tank floor 40, thereby permitting fluid to flow into the first designated area 43. In some embodiments, there is at least one gap between the first baffle portion 54 and at least one wall of the tank 30, thereby permitting fluid to flow into the first designated area 43.

In multiple embodiments, the baffle system 52 includes a means for shielding the sensing system 45. The means for shielding the sensing system 45 operates as a divider between the tank inlet 33 and the sensing system 45 and shields the sensing system 45 from initial contact with at least a portion of the material entering the tank 30 through the tank inlet 33. In some embodiments, the means for shielding the sensing system 45 consists of a second baffle portion 55 formed from at least one baffle 53 which shields the sensing system 45 from initial contact with at least a portion of the material entering the tank 30 through the tank inlet 33. In some embodiments, the second baffle portion 55 also aids in directing material downward such that the material can be further directed toward the pump 100. Embodiments include those wherein the second designated area 44 is formed by the second baffle portion 55 and the sides of the tank 30. In some embodiments, the height of the second baffle portion 55 is sufficient so that material which enters the tank 30 cannot flow over the top of the second baffle portion 55. Thus, in some embodiments, the height of the second baffle portion 55 is at least as high as the top of the toilet outlet 22. In some embodiments, the second baffle portion 55 is substantially vertical with respect to the tank floor 40. The second baffle portion 55 permits material to flow into the second designated area 44. In some embodiments, there is at least one gap between the second baffle portion 55 and the tank floor 40, thereby permitting fluid to flow into the second designated area 44. In some embodiments, there is at least one gap between the second baffle portion 55 and at least one wall of the tank 30, thereby permitting fluid to flow into the second designated area 44.

In multiple embodiments, the baffle system 52 includes a means for directing flow towards the first designated area 43. In some embodiments, the means for directing flow towards the first designated area 43 consists of a third baffle portion 56 formed from at least one baffle 53 which directs the flow of material toward the first designated area 43 as shown in FIG. 1. Embodiments include those wherein the third baffle portion 56 consists of a ramp that slopes downward toward the first designated area 43 in order to direct material entering the tank inlet 33 toward the pump 100. In some embodiments, the third baffle portion 56 directs material away from the second designated area 44 and towards the first designated area 43. In some embodiments, the third baffle portion 56 extends from the second baffle portion 55. Embodiments include those wherein the third baffle portion 56 has a curved surface. The third baffle portion 56 promotes the evacuation of the materials entering the tank 30 by directing flow towards the pump 100.

In multiple embodiments, the baffle system 52 includes a means for deflecting the inlet flow. With reference to FIGS. 1 and 2, in some embodiments, the means for deflecting the inlet flow consists of a fourth baffle portion 57 formed from at least one baffle 53 which directs material entering the tank inlet 33 toward the third baffle portion 56, the tank floor 40 or the pump 100. In some embodiments, the height of the fourth baffle portion 57 is sufficient so that material which enters the tank 30 cannot flow over the top of the fourth baffle portion 57. Thus, in some embodiments, the height of the fourth baffle portion 57 is at least as high as the top of the toilet outlet 22. In some embodiments, the fourth baffle portion 57 is substantially vertical with respect to the tank floor 40. In some embodiments, the fourth baffle portion 57 extends from the second baffle portion 55 and forms a concave surface with respect to the tank inlet 33 thereby directing material both downward toward the third baffle portion 56 and laterally toward the first designated area 43.

Figure 7:
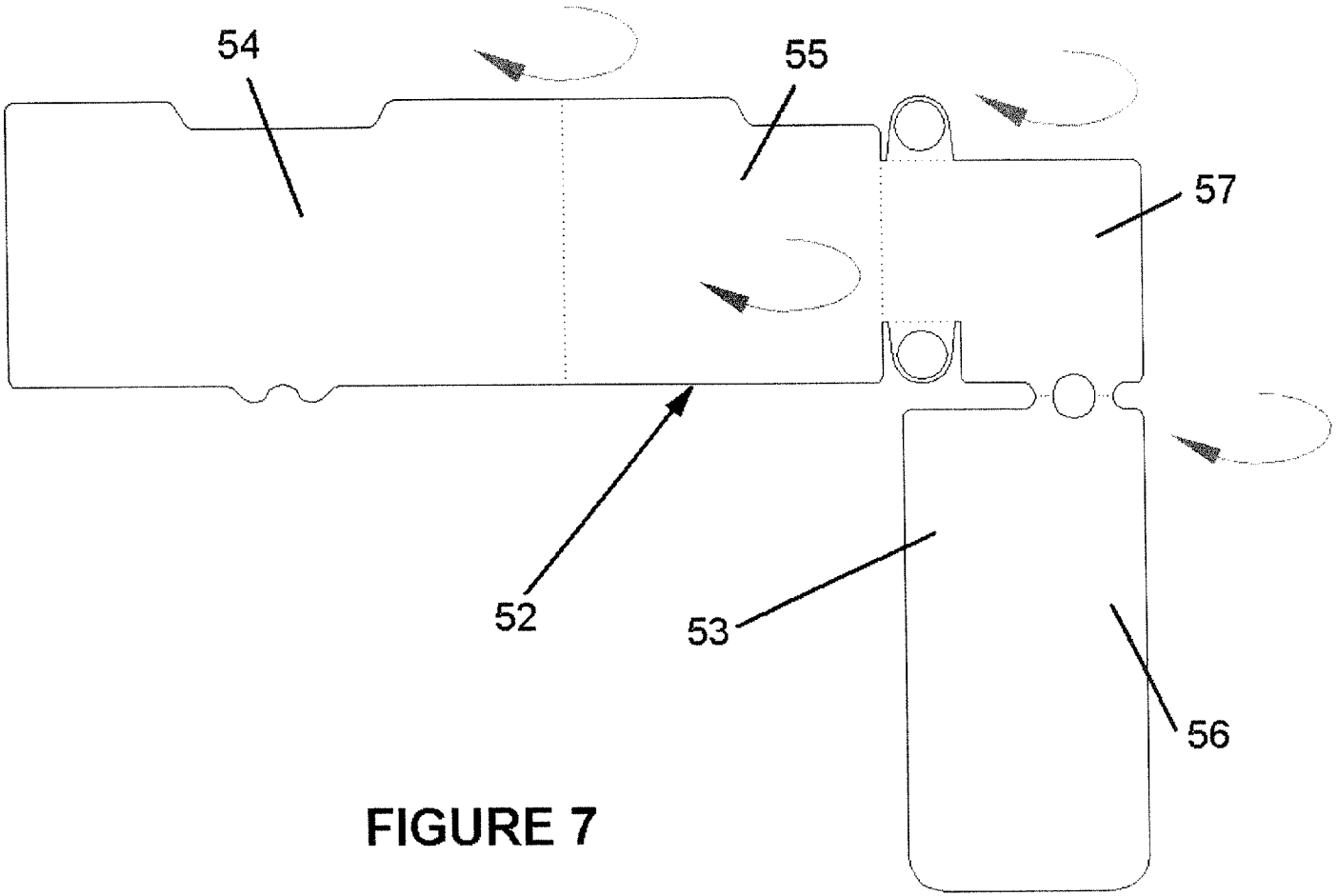
FIG. 7 is a plan view of a baffle system according to multiple embodiments and alternatives.

With reference to FIG. 6, embodiments include those wherein the baffle system 52 includes any or all of the following baffle portions: the first baffle portion 54, the second baffle portion 55, the third baffle portion 56, and the fourth baffle portion 57. In some embodiments, the baffle system 52 consists of one baffle 53. In some embodiments, this baffle 53 is comprised of a single folded sheet as shown in FIG. 7.

With reference to FIG. 1, embodiments include those wherein the arrangement of the baffle system 52 creates a fill differential within the tank 30. Regarding the fill differential, further details are provided as follows. As fluid enters the tank 30, the first designated area 43 fills faster than the second designated area 44 due to the encouragement of flow toward the first designated area 43 thereby creating a differential in the level of fluid between the first designated area 43 and the second designated area 44, i.e., the fill differential. This allows the first designated area 43 to fill before the sensing system 45 activates the pump 100. As the pump 100 evacuates the first designated area 43, fluid and material in the second designated area 44 move toward the first designated area 43; however, the level of fluid in the second designated area 44 typically remains higher than the level of fluid in the first designated area 43 thereby keeping the pump 100 energized. This ensures that substantially all of the material from the toilet 20 is pumped from the tank 30.

In multiple embodiments, the tank 30 also includes baffles 53 which extend vertically from the tank floor 40 and protect the second designated area 44 and the sensing system 45 from build up of solid waste discharged from the toilet 20. In some embodiments, the second designated area 44 is located on the up-stream side of the tank inlet 33 of the tank 30. By locating the second designated area 44 and the sensing system 45 on the up-stream side of the tank inlet 33 of the tank 30, the pattern of flow of material entering the tank inlet 33 is directed away from the sensing system 45 toward the pump 100. In some embodiments, the flow of the material away from the second designated area 44 toward the pump 100 creates a suction effect within the tank 30 which draws material and fluid that may be contained in the second designated area 44 toward the pump 100.

Embodiments include those wherein the waste pumping system 10 includes components which activate an alarm 47 when the level of material within the tank 30 is excessively high as selectably chosen by a user as shown in FIG. 1. For example, embodiments provide a high water alarm such as the Flood Alert®, produced by Zoeller Company, that is placed within the tank 30. Appropriate electrical connections can be made to the alarm 47 to provide electricity for the operation of the system. In some embodiments, the waste pumping system 10 is used to receive and pump fluids from multiple locations, such as from showers and water faucets. Embodiments include those wherein fluids from these other sources enter the tank 30 through secondary inlets 70. In some embodiments, the design of the floor 40 of the tank 30 encourages the flow of fluids entering via secondary inlets 70 toward the pump 100. Alternatives include those wherein the floor 40 near the secondary inlet 70 is curved to assist in prevention of the build up of solids and to assist in the flow of material toward the pump 100.

Figure 11:
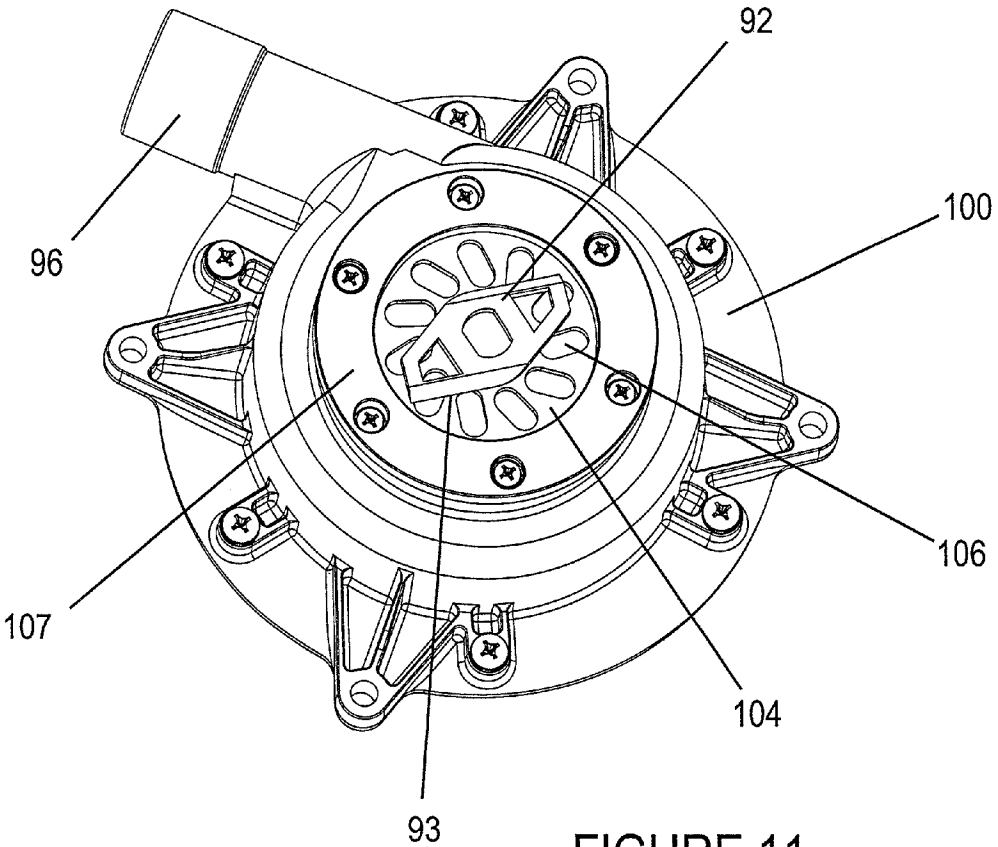
FIG. 11 is a perspective view of a pump housing according to multiple embodiments and alternatives.

With reference to FIG. 8, embodiments include those wherein the pump 100 operates as a grinder pump. It will be readily understood by those in the art that the pump 100 may be used not only with the waste pumping system 10 but also with any other appropriate application for grinder pumps. For example, embodiments include those wherein the pump 100 is used in a pump basin under a sink for grinding up food and other materials rinsed down a sink. The pump 100 includes a motor 120, a pump housing 122, an impeller 110, a shaft 114, a base 112 and the pump inlet 102. In some embodiments, the pump 100 operates as a centrifugal pump. In some embodiments, the pump 100 includes a mechanical seal 118 capable of sealing the pump 100 even if operated at high speeds, in some instances greater than 5000 rpm, and capable of withstanding sustained periods of dry run. With reference to FIG. 11, the pump 100 further includes a cutter plate 104 disposed at the pump inlet 102. The cutter plate 104 may be comprised of any suitable material including but not limited to stainless steel. The cutter plate 104 includes a series of holes 106. Fluid and material entering the pump inlet must pass through the holes 106. This ensures that solids are ground small enough to enter the pump inlet 102. The fluid and material then enters a pump chamber 108 as shown in FIG. 8. The impeller 110 is capable of pumping materials in the pump chamber 108 out through a discharge pipe 96.

Figure 14:
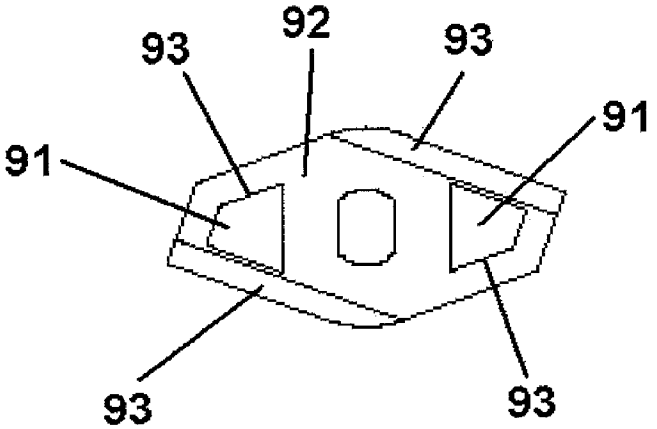
FIG. 14 is a plan view of a cutter blade according to multiple embodiments and alternatives.
Figure 14A:
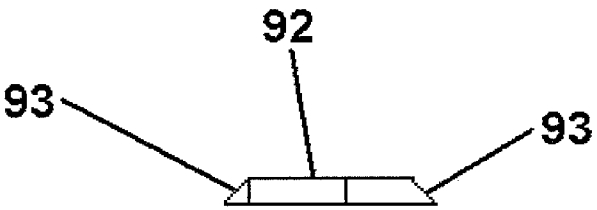
FIG. 14*a* is a side elevation view of a cutter blade according to multiple embodiments and alternatives.
Figure 15:
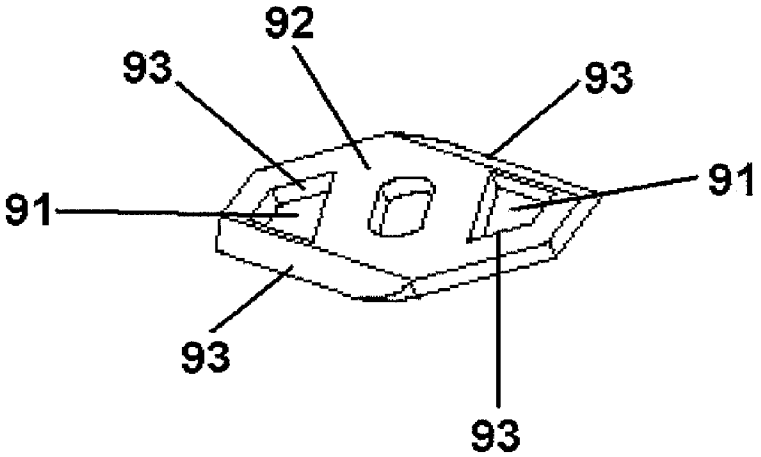
FIG. 15 is a perspective view of a cutter blade according to multiple embodiments and alternatives.

In multiple embodiments, the pump 100 further includes a cutter blade 92 disposed substantially adjacent to the cutter plate 104 as shown in FIG. 11. Further embodiments provide that the cutter blade 92 is in direct contact with the cutter plate 104. The cutter blade 92 is movable in relation to the cutter plate 104. Embodiments include those wherein the cutter blade 92 is rotatable. Alternatives include those wherein the cutter blade 92 is not in direct contact with the cutter plate 104. Alternatives include those wherein the separation between the cutter blade 92 and the cutter plate 104 is provided in a range from 0 to about 1 inch. Embodiments include those wherein the cutter blade 92 and the cutter plate 104 are substantially parallel to one another. The cutter blade 92 may be comprised of any material typically used in cutting or grinding applications including but not limited to stainless steel. In some embodiments, the cutter blade 92 is attached to the shaft 114 such that the shaft 114 is capable of providing the force required to rotate the cutter blade 92 as shown in FIG. 8. With reference to FIGS. 14, 14*a*, and 15, the cutter blade includes at least one cutting edge 93. In some embodiments, at least one cutting edge 93 is disposed on the perimeter of the cutter blade 92. In some embodiments, the cutter blade 92 has two cutting edges 93 disposed on the perimeter of the cutter blade 92 such that as the cutter blade 92 rotates, each cutting edge 93 faces the same rotational direction. Embodiments include those wherein the cutter blade 92 is capable of grinding up solids approaching the pump inlet 102. As the cutter blade 92 rotates, the cutting edges 93 pass by the holes 106 of the cutter plate resulting in a shearing effect between the cutting edges 93 and the holes 106. Solids approaching the pump inlet 102 are thereby ground up by the cutting edges 93 against the cutter plate 104.

Figure 12:
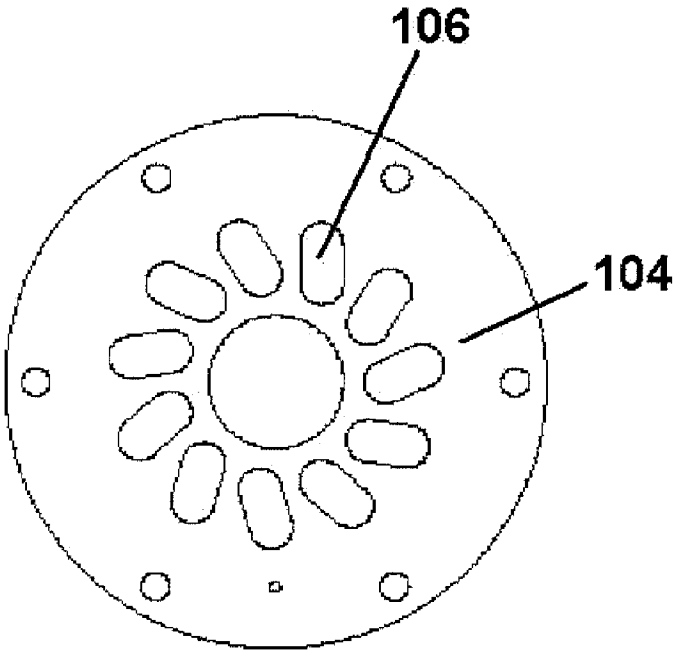
FIG. 12 is a plan view of a cutter plate according to multiple embodiments and alternatives.
Figure 13:
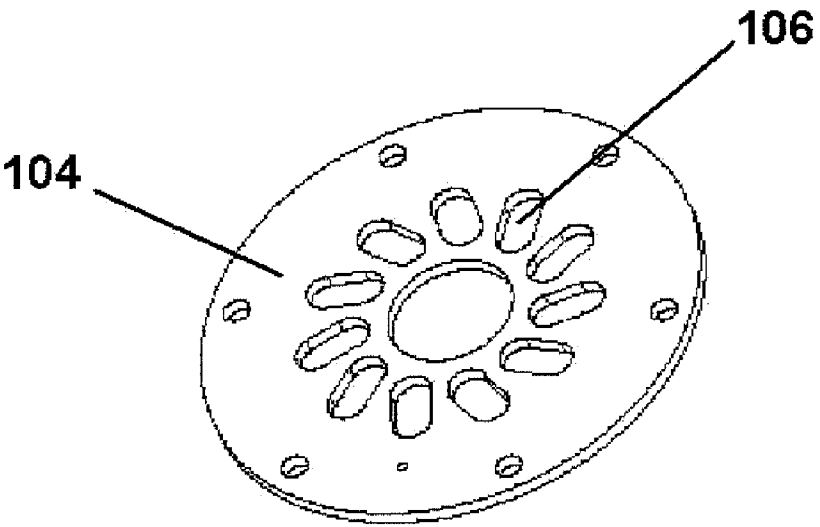
FIG. 13 is a perspective view of a cutter plate according to multiple embodiments and alternatives.

Embodiments include those wherein the holes 106 on the cutter plate 104 are substantially oval or oblong in shape as shown in FIGS. 12 and 13. In some embodiments, each hole 106 is angled in the direction of rotation of the cutter blade 92 as shown in FIG. 11. In this configuration, as the cutter blade 92 rotates and travels along a hole 106, the overlap between each cutting edge 93 and the hole 106 moves along the hole 106 away from the center-point of the cutter blade's rotation. The shape and angle of the holes 106 maximize the interaction between each cutting edge 93 and each hole 106 thereby increasing the cutting ability of the cutter blade 92. This increased cutting ability reduces the motor torque and cutting force required to reduce and grind up solids entering the pump inlet 102.

Alternatives include a pump 100 that is capable of reverse cut functionality. In these alternatives, the cutter blade 92 is capable of rotating in a first direction as well as a second direction wherein the second direction is opposite the first direction. In some embodiments, the cutter blade 92 is capable of rotating both clockwise and counter-clockwise as perceived when facing the pump inlet 102 from the exterior of the pump. In these alternatives, the cutter blade 92 includes at least two cutting edges 93 disposed on the perimeter of the cutter blade 92. The cutter blade 92 has at least one cutting edge 93 that faces clockwise and at least one cutting edge 93 that faces counter-clockwise such that there is at least one cutting edge 93 utilized when the cutter blade 92 rotates clockwise and at least one cutting edge 93 utilized when the cutter blade 92 rotates counter-clockwise. In some alternatives, the cutter blade 92 has four cutting edges 93 disposed on the perimeter of the cutter blade 92 such that there are two cutting edges 93 utilized when the cutter blade 92 rotates clockwise and two cutting edges 93 utilized when the cutter blade 92 rotates counter-clockwise. Embodiments include those wherein the reverse cut functionality allows the pump 100 to unwind material that becomes wound up in the cutter blade 92.

With reference to FIGS. 14 and 15, embodiments include those wherein the cutter blade 92 includes at least one relief hole 91. Alternatives include a cutter blade 92 with two relief holes 91. In some embodiments, each relief hole 91 includes at least one cutting edge 93. In some embodiments, the angle of each cutting edge 93 within a relief hole 91 with respect to the face of the cutter plate 104 is between about 0° and about 90°.

In some embodiments, the angles of the cutting edges 93 within the relief holes 91 are substantially equal to the angles of the cutting edges 93 disposed on the perimeter of the cutter blade 92. Alternatives include those wherein the angles of the cutting edges 93 within the relief holes 91 are not equal to the angles of the cutting edges 93 disposed on the perimeter of the cutter blade 92. Alternatives include those wherein each relief hole 91 has one cutting edge 93 such that as the cutter blade 92 rotates, each cutting edge 93 faces in the same rotational direction. Alternatives include those wherein each relief hole 91 has at least two cutting edges 93 such that in alternatives wherein the cutter blade 92 is capable of rotating both clockwise and counter-clockwise, each relief hole 91 has a cutting edge 93 which faces clockwise and each relief hole 91 has a cutting edge 93 which faces counter-clockwise. The inclusion of a cutting edge 93 within each relief hole 91 increases the cutting ability of the cutter blade 92. This, in turn, reduces the motor torque and cutting force required to reduce and grind up solids entering the pump inlet 102. The relief holes 91 also allow material trapped under the cutter blade 92 to escape thereby substantially reducing the occurrence of binding of the cutter blade 92.

With reference to FIG. 11, embodiments include those wherein the pump inlet 102 includes a ring 107. The ring 107 extends outward from the pump inlet 102 in a substantially circular manner. The ring 107 is capable of channeling fluid and material into the pump inlet 102 such that fluid and material enters the pump inlet 102 with a substantially perpendicular approach with respect to the cutter plate 104. This substantially reduces the opportunity for solids to catch and become trapped underneath the cutter blade 92 and wrap around the shaft 114.

Figure 16:
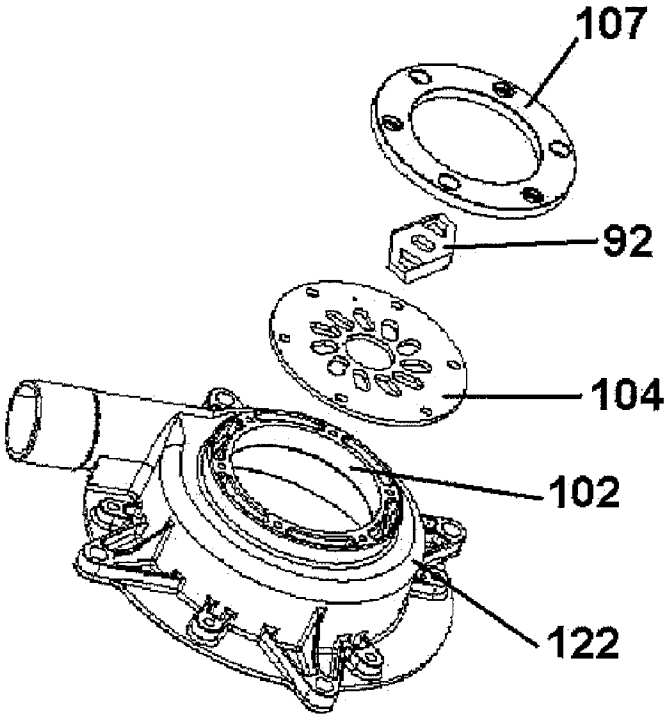
FIG. 16 is an exploded view of a pump according to multiple embodiments and alternatives.

In some embodiments, the ring 107 is bolted to the pump housing 122 at the pump inlet 102 as shown in FIG. 16. However, the ring 107 may attach to the pump 100 by any suitable means. Alternatively, the ring 107 may be a part of the pump housing 122. Alternatives include those wherein the ring 107 secures the cutter plate 104 to the pump housing 122 at the pump inlet 102. However, the cutter plate 104 may be attached to the pump 100 by any suitable means.

In multiple embodiments, the arrangement and design of the cutter blade 92 and the cutter plate 104 and holes 106 increases the cutting ability of the cutter blade 92 and thereby minimizes the motor torque and cutting force required to effectively reduce and grind up solids entering the pump inlet 102. This allows the pump 100 to operate with a lower horsepower motor 120 than existing grinder pumps without sacrificing cutting ability or cutting efficiency. For example, the pump 100 is capable of substantially reducing items typically found in sanitary sewage applications such as, for example, feces, disposable diapers, sanitary napkins, paper towels, rubber materials, and plastics while operating with a motor 120 of 0.5 hp.

Figure 9:
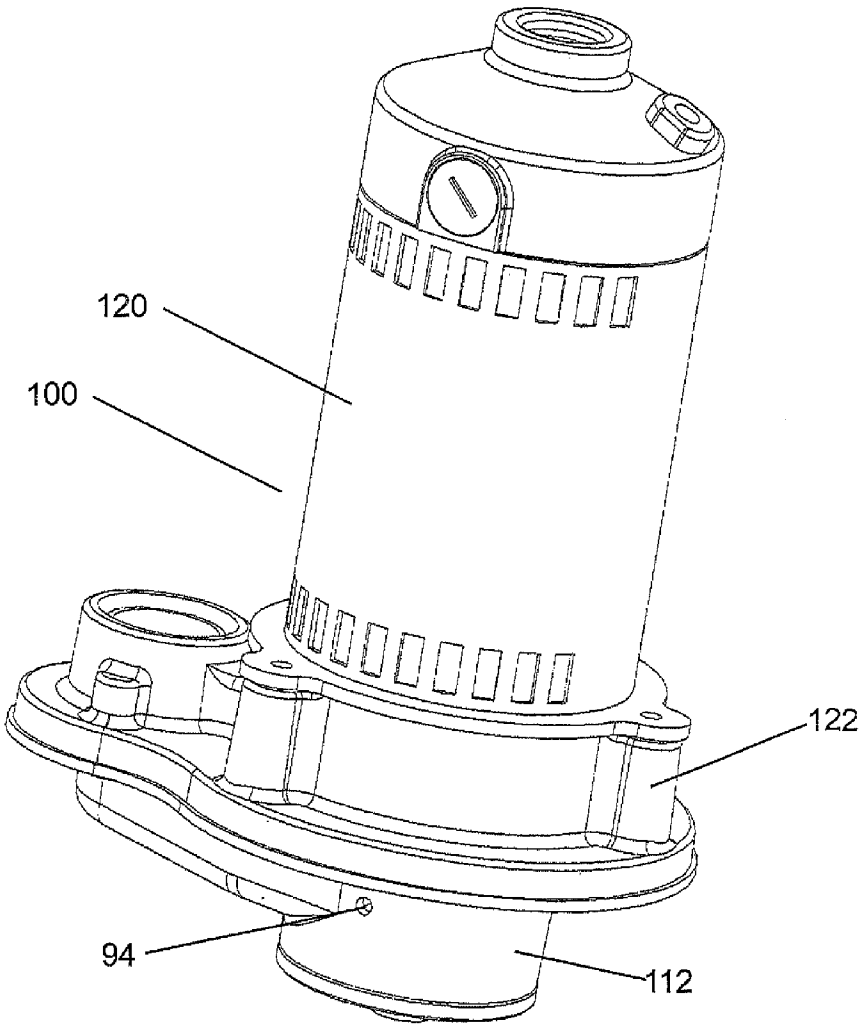
FIG. 9 is perspective view of a pump according to multiple embodiments and alternatives.

Embodiments include those wherein the pump 100 includes a discharge opening 94 as shown in FIG. 9. Embodiments include those wherein the discharge opening 94 is disposed in the base 112. The discharge opening 94 prevents air locking and also produces a jet stream of fluid to assist in the flow of material within the tank 30. In some embodiments, the discharge opening 94 is designed to expel fluid from the pump 100 under pressure toward the at least one baffle 53. Embodiments include those wherein the fluid from the discharge opening 94 creates a flow pattern which encourages the flow of material toward the pump 100. In some embodiments, this flow pattern created by the discharge of fluid from the discharge opening 94 also creates a suction effect, drawing fluid away from the second designated area 44. This aids in keeping the second designated area 44 clean from solid waste.

With reference to FIGS. 3-5, embodiments include those wherein the tank 30 is covered by a tank cover 60. The tank cover 60 provides easy access to the tank 30 and the pump 100. Alternatives include those wherein the tank cover 60 includes an opening for a vent pipe 98. The vent pipe 98 vents gases contained with the waste pumping system 10. In some embodiments, the tank cover 60 includes an opening for the discharge pipe 96. The tank cover 60 may further include other openings for other purposes.

In multiple embodiments, waste is discharged from the toilet 20 through the toilet outlet 22 through the tank inlet 33 into the tank 30 as shown in FIG. 4. With reference to FIG. 1, upon entering the tank 30, the waste encounters the fourth baffle portion 57 which directs the flow of waste toward the third inlet portion 56 which encourages the flow of material toward the pump 100. Once the level of material in the second designated area 44 reaches a predetermined level, the sensing system 45 activates the pump 100. Flow is further encouraged by the liquid expelled under force through the discharge opening 94 in the pump 100 once the pump 100 has been activated as shown in FIG. 9. The material then enters the pump 100 where it is ground up by use of the cutting blade 92 and is discharged through the discharge pipe 96 to an above-grade piping system by the pumping action of the impeller 110 as shown in FIG. 11.

It will therefore be readily understood by those persons skilled in the art that the embodiments and alternatives of a waste pumping system 10 and a pump 100 are susceptible to a broad utility and application. While the embodiments are described in all currently foreseeable alternatives, there may be other, unforeseeable embodiments and alternatives, as well as variations, modifications and equivalent arrangements that do not depart from the substance or scope of the embodiments. The foregoing disclosure is not intended to be construed to limit the embodiments or otherwise to exclude such other embodiments, adaptations, variations, modifications and equivalent arrangements, the embodiments being limited only by the claims appended hereto and the equivalents thereof.

What is claimed is:

1. A pump comprising:

a cutter plate disposed at a pump inlet, the cutter plate including a plurality of holes;

a rotatable cutter blade disposed substantially adjacent to the cutter plate, the cutter blade having at least one cutting edge and at least one relief hole; and the plurality of holes being angled in a direction of rotation of the cutter blade.

2. The pump of claim 1, further comprising the shape of the holes being chosen from the group: oval and oblong circle.

3. The pump of claim 1, wherein the cutter blade is in direct contact with the cutter plate.

4. The pump of claim 1, further comprising a ring extending outward from the pump inlet for channeling material toward the pump inlet in a substantially perpendicular approach with respect to the cutter plate.

5. The pump of claim 1, further comprising a shaft connected to the cutter blade and a motor for rotating the shaft and the cutter blade.

6. A pump comprising:

a rotatable cutter blade disposed substantially adjacent to a pump inlet, the cutter blade having at least one relief hole and at least one cutting edge disposed on the perimeter of the cutter blade;

wherein the at least one relief hole has at least one cutting edge, the angle of which is not equal to the angle of the at least one cutting edge disposed on the perimeter of the cutter blade.

7. The pump of claim 6, further comprising a shaft connected to the cutter blade and a motor for rotating the shaft and the cutter blade.

8. The pump of claim 6, wherein the at least one relief hole has at least one cutting edge facing the first direction of rotation and at least one cutting edge facing the second direction of rotation.

9. The pump of claim 6, wherein the cutter blade has at least one cutting edge disposed on the perimeter of the cutter blade facing the first direction of rotation and at least one cutting edge disposed on the perimeter of the cutter blade facing the second direction of rotation.

10. The pump of claim 6, further comprising a cutter plate disposed at the pump inlet including a plurality of holes angled in a direction of rotation of the cutter blade.

11. The pump of claim 6, further comprising a cutter plate disposed at the pump inlet and a ring extending outward from the pump inlet for channeling material toward the pump inlet in a substantially perpendicular approach with respect to the cutter plate.

12. A pump comprising:

a cutter plate disposed at a pump inlet including a plurality of holes;

a ring extending outward from a pump inlet for channeling material toward the pump inlet in a substantially perpendicular approach with respect to the cutter plate; and a rotatable cutter blade disposed substantially adjacent to the cutter plate, the cutter blade having at least one cutting edge and at least one relief hole.

13. The pump of claim 12, wherein the ring secures the cutter plate to a pump housing.

14. The pump of claim 12, further comprising a rotatable cutter blade disposed substantially adjacent to the cutter plate, a shaft connected to the cutter blade, and a motor for rotating the shaft and the cutter blade.

15. A pump comprising:

a rotatable cutter blade disposed substantially adjacent to a pump inlet, the cutter blade having at least one relief hole and at least one cutting edge; and a cutter plate disposed at the pump inlet including a plurality of holes angled in a direction of rotation of the cutter blade.

16. A pump comprising:

a rotatable cutter blade disposed substantially adjacent to a pump inlet, the cutter blade having at least one relief hole and at least one cutting edge;

a cutter plate disposed at the pump inlet; and a ring extending outward from the pump inlet for channeling material toward the pump inlet in a substantially perpendicular approach with respect to the cutter plate.

* * * * *